United States Patent [19]

Marsh

[11] Patent Number: 4,729,318

[45] Date of Patent: Mar. 8, 1988

[54] EXPLOSIVE PLANE-WAVE LENS

[75] Inventor: Stanley P. Marsh, Los Alamos, N. Mex.

[73] Assignee: The United States of America as represented by the United States Department of Energy, Washington, D.C.

[21] Appl. No.: 25,022

[22] Filed: Mar. 12, 1987

[51] Int. Cl.[4] ..... F42B 1/02

[52] U.S. Cl. ..... 102/308; 102/307; 102/310; 102/476

[58] Field of Search ..... 102/306, 307, 308, 476, 102/310, 339

[56] References Cited

U.S. PATENT DOCUMENTS

| | | | |
|---|---|---|---|
| 3,186,304 | 6/1965 | Biehl | 102/306 X |
| 3,437,036 | 4/1969 | Franzen et al. | 102/476 X |
| 3,478,685 | 11/1969 | Thomanek et al. | 102/306 |
| 3,796,158 | 3/1974 | Conger | 102/701 X |
| 3,876,960 | 4/1975 | DeKoker et al. | 102/306 X |
| 3,906,857 | 9/1975 | Rotondi, Jr. | 102/476 X |
| 3,967,553 | 7/1976 | Keraus et al. | 102/306 X |
| 3,985,077 | 10/1976 | Conger et al. | 102/475 |
| 4,499,828 | 2/1985 | Honodel | 102/306 X |
| 4,537,132 | 8/1985 | Sabranski et al. | 102/476 X |
| 4,665,826 | 5/1987 | Marer | 102/476 X |

FOREIGN PATENT DOCUMENTS

| | | | |
|---|---|---|---|
| 150241 | 1/1984 | European Pat. Off. | 102/306 |
| 3017785 | 5/1980 | Fed. Rep. of Germany | 102/306 |

*Primary Examiner*—Peter A. Nelson

*Attorney, Agent, or Firm*—David K. Cornwell; Paul D. Gaetjens; Judson R. Hightower

[57] ABSTRACT

An explosive plane-wave air lens which enables a spherical wave form to be converted to a planar wave without the need to specially machine or shape explosive materials is described. A disc-shaped impactor having a greater thickness at its center than around its periphery is used to convert the spherical wave into a plane wave. When the wave reaches the impactor, the center of the impactor moves first because the spherical wave reaches the center of the impactor first. The wave strikes the impactor later in time as one moves radially along the impactor. Because the impactor is thinner as one moves radially outward, the velocity of the impactor is greater at the periphery than at the center. An acceptor explosive is positioned so that the impactor strikes the acceptor simultaneously. Consequently, a plane detonation wave is propagated through the acceptor explosive.

13 Claims, 4 Drawing Figures

EXPLOSIVE PLANE-WAVE LENS

The invention relates generally to explosive detonators and, more specifically, to an explosive plane-wave lens which does not require extensive machining of explosives. This invention is the result of a contract with the Department of Energy (Contract No. W-7405-ENG-36).

BACKGROUND OF THE INVENTION

In the field of high explosives it is often necessary to shape the detonation shock wave to a prescribed pattern. If a point source is used to detonate a right cylinder of explosive material, the shock wave will propagate through the cylinder in a spherical pattern. The exiting shock wave will be spherical as well. If the desired shape of the shock wave is planar, then a lens must be used to reshape the wave.

One of the most common ways to convert a point source shock wave into a plane wave is by tailoring the shape of the explosive material. A typical explosive plane-wave lens includes a first cone made of a low velocity detonation material such as baratol (a mixture of barium nitrate and TNT). The flat portion of the cone is positioned against the device for which the user intends to transmit a planar wave. A second detonation material having a high detonation velocity is cast over the baratol and machined so the outside contour is cone shaped. In operation a detonator is used to initiate the high detonation velocity explosive at the apex of the cone. By the time the wave has reached the flat end of the cone, the shock wave is planar. This method is described in U.S. Pat. No. 2,604,042.

There are a number of severe drawbacks to tailoring the shape of a shock wave by shaping the explosive material. The first drawback to the above-described approach is that it is extremely costly to machine explosive material. In the plane-wave device described above, the baratol is first cast and then machined to high tolerances. A second material is then over cast and again machined. This repeated machining of explosive material requires special remote controlled machinery to insure safety. There are few machine shops which have the proper equipment to machine explosives in this way.

Another difficulty with standard plane-wave lenses is that approximately two-thirds ($\frac{2}{3}$) of the raw explosive material is wasted in the machining process. Because baratol has a significant barium component, the wasted material is toxic and must be disposed of in a safe manner. The standard plane-wave lens is, therefore, expensive and potentially dangerous to the environment.

Baratol is not a highly controlled substance and, therefore, has varying properties batch-to-batch. Because it is often necessary to have maximum variations of 0.2 $\mu$s in the time of arrival of a shock wave, each batch of baratol must be analyzed and new calculations must be undertaken to determine cone angles ($\alpha$ and $\beta$) of the baratol and the second explosive. The relative velocities of the two explosives allow a plane wave to be formed. If the baratol has varying detonation velocities, it becomes difficult and time consuming to produce a uniform quality product.

It is therefore an object of the present invention to provide an explosive plane-wave air lens which does not require expensive machining of explosive material.

Another object of the invention is to provide an explosive plane-wave air lens which can be fabricated without generating toxic waste.

Another object of the invention is to provide an explosive plane-wave air lens which has repeatable and reliable performance.

SUMMARY OF THE INVENTION

The invention is an explosive air lens which uses an impactor to convert a detonation wave from one wave form to another.

A donor explosive is used to propagate a detonation wave to an impactor that is placed in its path. The impactor has a shape effective to convert the shock wave to a predetermined wave form. The impactor has varying thickness so that the thinner sections move at greater velocities than the thicker sections allowing resulting wave forms to be tailored. An acceptor explosive is used to receive and propagate the tailored wave.

An advantage of the present invention is that the only part which needs to be contour machined is the impactor. No explosive material needs to be contour machined.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION OF THE PREFERRED EMBODIMENTS

It is desired to have an explosive plane-wave air lens which converts a spherical detonation wave emanating from a point source to a plane wave without the need of expensive and environmentally dangerous machining of explosive material.

Figure 1B:
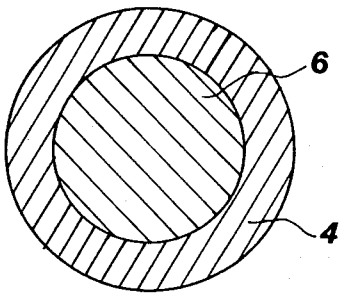
Fig. 1b (PRIOR ART)
FIG. 1*b* is a cross sectional view along line 1*b*–1*b* of FIG. 1*a*.
Figure 1A:
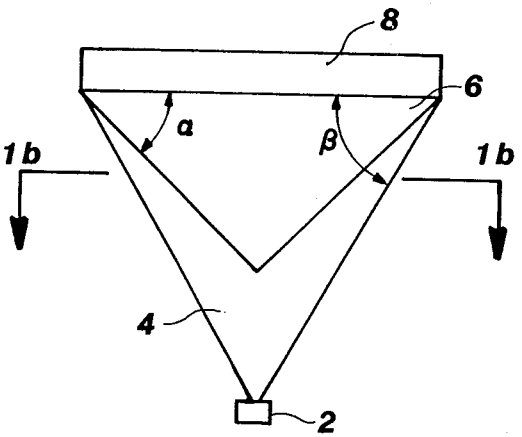
Fig. 1a (PRIOR ART)
FIG. 1*a* is a cross sectional view of the prior art.

FIGS. 1*a* and 1*b* illustrate a well-known plane-wave lens. Point source 2 is used to detonate a fast explosive 4 such as Composition B. A shock wave having a spherical surface emanates from point source 2 but begins to convert to a plane wave when the spherical wave reaches the apex of slow detonation velocity material 6. The shock wave continues to move rapidly through the fast explosive 4 and slowly through slow detonation velocity material 6. Angles $\alpha$ and $\beta$, denoting the slope of the cone-shaped explosive materials, are chosen so that the shock wave is planar when it arrives at explosive material 8.

To fabricate the plane-wave lens, which is depicted in FIGS. 1*a* and 1*b*, the slow detonation velocity material 6, for example, baratol, is cast and then machined to high tolerance in the shape of a cone with preselected angle of rise $\alpha$. The angle $\alpha$ must be calculated for each batch of baratol because the properties of this explosive are not well controlled. After this wasteful and difficult machining is accomplished, an explosive with a high detonation velocity 4 is over cast and the outer surface machined to a specified outer contour.

The present invention accomplishes the same end as the device depicted in FIGS. 1*a* and 1*b* without the need of contouring explosive material.

Figure 2:
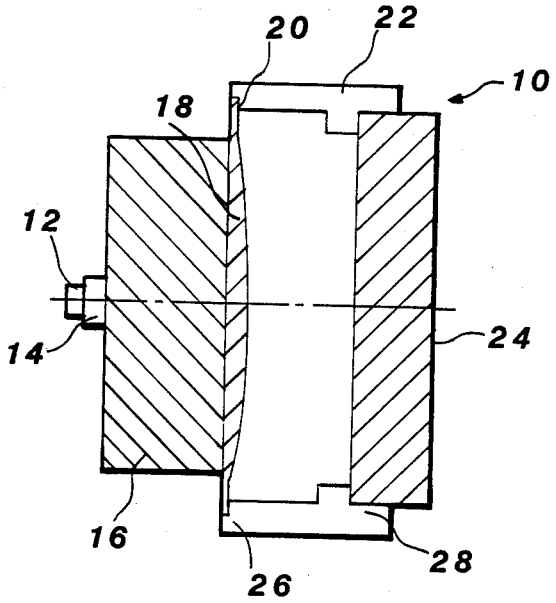
FIG. 2 is a cross sectional schematic of one embodiment of the invention.

FIG. 2 illustrates a preferred embodiment of the present invention. The plane-wave lens 10 of the invention uses a detonator 12 which generates a spherically shaped shock wave with the detonator 12 being the origin. A booster 14 may be necessary to ignite explosive material 16 which may be, for example, PBX 9501.

The explosive material donor 16 is a right cylinder which is disc shaped and, therefore, does not require complicated contouring. If a 12 in. diameter disc is used, the thickness of explosive material donor 16 is preferably about 2 in. It was found that if the width of the donor 16 is reduced to 1 in., there is spalling of the impactor due to the high pressure gradient in the material.

Impactor 18 is located to receive the spherical detonation wave after it has traveled through donor 16. The embodiment shown in FIG. 2 has impactor 18 in contact with donor 16 and opposite the point source detonator 12. It should be noted that in another embodiment of the invention, there may be a space between donor 16 and impactor 18.

The impactor 18 may be made of stainless steel or any other suitable material. Although there may be a number of variations, in a preferred embodiment, the impactor 18 is round and has a diameter substantially the same as donor 16. At the circumference of the impactor is a flange 20 which extends circumferentially about the impactor 18 and beyond the diameter of the donor 16. Flange 20, in combination with spacer 22 (described below), helps to prevent gases from donor 16 from prematurely detonating the acceptor explosive 24. Without flange 20 extending beyond the diameter of donor 16 it was found that gases from the side of donor 16 would travel around the spacer 22 and ignite the corners of acceptor explosive 24.

The impactor should be made of a metal which has high density, tensile strength, and strain rate ductility. The metal should also be easily machined, have good dimensional stability and be inexpensive. A metal with high tensile strength reduces the probability of Taylor-wave spall. The high strain rate ductility requirement prevents brittle fracture during the forging process and the need for stability, machinability and low material cost help keep the overall process of making the impactor inexpensive.

A metal which is a compromise for satisfying these requirements is stainless steel 304L. A heat-treat may be used to eliminate the strains in the material prior to machining. To heat-treat the metal may be held in a vacuum furnace for two hours at 1090° C. followed by a one hour furnace-cool to 260° C.

FIG. 2 depicts a representative shape of impactor 18. As shown, impactor 18 is disc shaped and is thicker at the center and narrower at the circumference. In a preferred embodiment, one surface of impactor 18 is flat and the surface of impactor 18 which is away from detonator 12 follows four segmented elliptical or hyperbolic paths in a radially outward direction from the center of impactor 18 to the periphery. Naturally, dimensions can be tailored to produce a shock wave of any desired shape. The above-described impactor shape produces a planar wave.

The impactor 18 is spaced apart from an acceptor explosive 24 by a cylindrical spacer 22 which extends out over the periphery of the impactor 18 and the acceptor explosive 24. A preferred spacing between the center of impactor 18 and the acceptor explosive 24 is about 3.5 cm. Aluminum alloy 6061 has been found to be a suitable material for the spacer 22. Shoulders 26 and 28 may be added to the spacer to provide alignment.

Acceptor explosive 24 is comprised of a high explosive material such as PBX 9501. As with the donor 16, this explosive material is a right cylinder which is substantially disc shaped and does not require difficult contour machining. For a 30.48 cm (12 in.) acceptor 24, a thickness of approximately 2.54 cm (1 in.) may be used to achieve desired results.

In operation, the detonator 12 is fired which in turn detonates the booster 14 if a booster is used. A detonation is generated which propagates through donor 16. Because the shock wave is circular (in cross section), the wave reaches the center of the impactor 18 first. The center of the impactor 18 bows because of the impact of the detonation wave. As time continues the detonation wave reaches the points closer and closer to the periphery of the impactor 19. The final velocity of the impactor 18 is a function of its thickness and density. Therefore the periphery of the impactor moves approximately twice as fast as the center. Even though the center of the impactor 18 receives the shock wave from the point source first, by the time the impactor 18 strikes the acceptor 24, the periphery and the center of the impactor 18 strike the acceptor 24 nearly simultaneously resulting in a plane wave through acceptor 24.

Using a 5.08 cm (2 in.) thick donor explosive 16 having a diameter of 30.48 cm (12 in.), an impactor 18 with a maximum thickness of 0.923 cm and a 0.2 cm thick flange 20, a minimum acceptor 24 to impactor 18 spacing of 3.5 cm, an aluminum spacer 22, an acceptor 24 thickness of 2.54 cm (1 in.), and a booster 14 the maximum variation time for the time of arrival of the shock wave to a conventional smear camera analyzer was approximately 0.2 μs. By modifying and optimizing the thickness of the materials and spacings, a smaller variation is expected.

The contouring of the impactor (for study using a Eulerian hydrodynamic code) was accomplished with segmented ellipses or hyperbolas or both. Both the position and slope of these functions were matched at the segment junction.

Although many options are available for the shape of the impactor depending on the ultimate wave shape desired by the user, several contours were used in a hydrodynamic study. The functional form describing the shape of the impactor is:

$$X = a_0 + a_1 \sqrt{a_2(Y + a_3)^2 + a_4}\ , \quad Y_{min} < Y < Y_{max}$$

Table I shows different values of $a_0$, $a_1$, $a_2$, $a_3$, and $a_4$. It should be noted that the origin is the center back face of the impactor. The contour extends in all directions for purposes of this example. Each of the lenses shown in Table I have the following invariant parameters.

| | | |
|---|---|---|
| Impactor | edge thickness | 0.200 cm |
| Donor explosive | material | PBX 9501 |
| Acceptor Explosive | material | PBX 9501 |
| | thickness | 2.54 cm |

The impactor thickness contours shown in Table I were initially calculated hydrodynamically and then experimental iterations were used to obtain the final results.

Table II shows some parameters used in a series of shots using the contours of Table I. All these shots were made with an SE-1 detonator. Other conditions of the shots are shown in Table II.

TABLE I

Segmented Functions Used To Describe Impactor Explosive Contour

| | $a_0$ | $a_1$ | $a_2$ | $a_3$ | $a_4$ | $Y_{min}$ (cm) | $Y_{max}$ (cm) |
|---|---|---|---|---|---|---|---|
| Contour 1 | 1.51252 | −1 | $6.37100 \times 10^{-3}$ | 0 | 0.375181 | 0 | 6 |
| | −0.77536 | +1 | $4.96440 \times 10^{-4}$ | −155.577 | −8.82581 | 6 | 15.24 |
| Contour 2 | 1.51666 | −1 | $6.40375 \times 10^{-3}$ | 0 | 0.380270 | 0 | 6 |
| | −0.78282 | +1 | $4.78897 \times 10^{-4}$ | −161.843 | −9.32671 | 6 | 15.24 |
| Contour 3 | 1.17207 | −1 | $3.58026 \times 10^{-3}$ | 0 | $6.20359 \times 10^{-2}$ | 0 | 6 |
| | −0.78282 | +1 | $4.78897 \times 10^{-4}$ | −161.843 | −9.32671 | 6 | 15.24 |
| Contour 4 | 1.22571 | −1 | $3.73825 \times 10^{-3}$ | 0 | 0.108050 | 0 | 4 |
| | 1.10095 | −1 | $3.35305 \times 10^{-3}$ | −0.898488 | $4.89421 \times 10^{-2}$ | 4 | 8 |
| | 2.45975 | −1 | $7.44942 \times 10^{-3}$ | 4.49812 | 2.16974 | 8 | 12 |
| | −0.72639 | +1 | $6.35526 \times 10^{-4}$ | −119.364 | −6.03204 | 12 | 15.24 |
| Contour 5 | 0.89851 | +1 | $-9.28000 \times 10^{-7}$ | 0 | $2.40100 \times 10^{-7}$ | 0 | 0.5 |
| | 0.92687 | −1 | $6.46458 \times 10^{-4}$ | −0.274783 | $7.66403 \times 10^{-4}$ | 0.5 | 2 |
| | 1.22571 | −1 | $3.73825 \times 10^{-3}$ | 0 | 0.108050 | 2 | 4 |
| | 1.10095 | −1 | $3.35305 \times 10^{-3}$ | −0.898488 | $4.89421 \times 10^{-2}$ | 4 | 8 |
| | 2.45975 | −1 | $7.44942 \times 10^{-3}$ | 4.49812 | 2.16974 | 8 | 12 |
| | −0.72639 | +1 | $6.35526 \times 10^{-4}$ | −119.364 | −6.03204 | 12 | 15.24 |

TABLE II

| Run | Booster | Donor Thickness (cm) | Impactor Material | Impactor Axial Thickness (cm) | Impactor Axial Free Run (cm) | Impactor Flange | Impactor Contour (From Table I) |
|---|---|---|---|---|---|---|---|
| 1 | Yes | 5.08 | SS-304L | 0.900 | 3.50 | No | 2 |
| 2 | Yes | 2.54 | SS-304L | 0.923 | 2.58 | Yes | 3 |
| 3 | Yes | 5.08 | SS-304L | 0.923 | 3.48 | Yes | 3 |
| 4 | No | 5.08 | SS-304L | 0.900 | 3.39 | Yes | 1 |
| 5 | No | 5.08 | SS-304L | 0.897 | 3.41 | Yes | 4 |
| 6 | No | 5.08 | Brass | 0.897 | 3.22 | Yes | 4 |
| 7 | No | 5.08 | SS-304L | 0.897 | 3.52 | Yes | 4 |
| 8 | No | 5.08 | SS-304L | 0.899 | 3.37 | Yes | 5 |

Spalling problems were encountered in runs 2 and 6. In run 2 the donor thickness of 2.54 cm was caused by too large a stress gradient in the impactor. Brass was used in run 6 instead of the steel used in the other runs. By modifying the dimensions of the brass impactor it is believed that satisfactory results can be obtained. Table III shows simultaneously results of runs 1, 3–5, 7, and 8.

Figure 3:
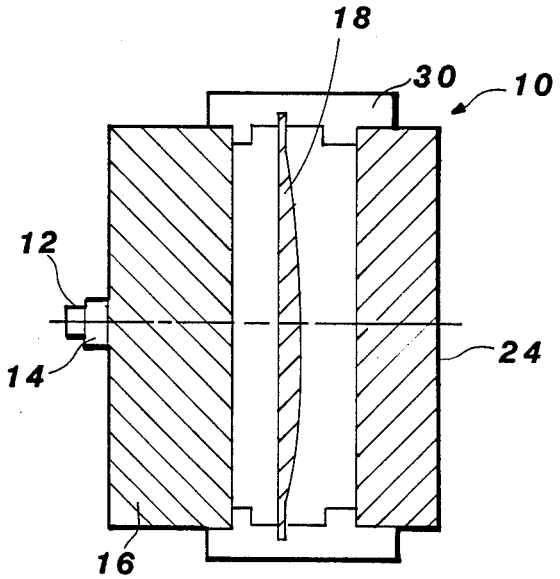
FIG. 3 is a cross sectional schematic of another embodiment of the invention.

In an embodiment shown in FIG. 3, the impactor 18 and the donor 16 are separated by a spacer 30. Material such as aluminum or Plexiglas® may be used to make spacer 30. By separating the impactor 18 and donor 16 it is possible to use less donor material.

The foregoing descriptin of the specific device used in accordance with the invention has been presented for purposes of illustration and description. It is not intended to be exhaustive or to limit the invention to the precise form disclosed. For example, it may be advantageous to generate a shock wave having a shape which is neither planar nor spherical. By tailoring the shape of the impactor the specific shape needed can be generated. This change merely requires a change in the shape of an easily machinable component of the invention, the impactor. The devices were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

TABLE III

| Run | Maximum Time Variation In Arrival of Shock | Comments |
|---|---|---|
| 1 | .24 μs (excluding edge effects) | The outer edge of the acceptor detonated early because there was not a flange included on the impactor. |
| 3 | .32 μs | |
| 4 | .15 μs | |
| 5 | .20 μs | |
| 7 | .25 μs | |
| 8 | .28 μs | |

I claim:

1. An explosive wave lens comprising:

a. a donor explosive;

b. detonator means for generating a detonation wave in said donor explosive;

c. an acceptor explosive;

d. impactor means for receiving said detonation wave and for striking said acceptor explosive to produce a second detonation wave having a predetermined form in said acceptor explosive; and e. spacer means for spacing said impactor means apart from said acceptor explosive.

2. The device as recited in claim 1 wherein said impactor means comprises a substantially disc shaped impactor which is thickest in the center and decreases in thickness in a radial direction.

3. The device as recited in claim 2 wherein said detonator means comprises a point source detonator and a booster pellet.

4. The device as recited in claim 3 wherein said donor explosive and said acceptor explosive are right cylinders.

5. The device as recited in claim 4 wherein said impactor means is substantially disc shaped.

6. The device as recited in claim 5 further comprising a flange located around the periphery of said impactor, said flange being effective to engage said spacer means.

7. The device as recited in claim 6 wherein means for generating a detonation wave, the longitudinal axis of said donor explosive, and the center of said impactor means are aligned.

8. The device as recited in claim 7 wherein the impactor is thickest in the center and decreases in thickness in a radial direction.

9. The device as recited in claim 8 wherein one side of said disc-shaped impactor is substantially flat.

10. The device as recited in claim 9 wherein said impactor and said donor are in contact.

11. The device as recited in claim 9 wherein said impactor and said donor are spaced apart.

12. The device as recited in claim 10 wherein said flange extends beyond the diameter of said donor explosive.

13. The device as recited in claim 11 wherein said flange extends beyond the diameter of said donor explosive.

* * * * *